US008776417B2

(12) United States Patent
Jain et al.

(10) Patent No.: US 8,776,417 B2
(45) Date of Patent: Jul. 15, 2014

(54) BUSINESS FORM WITH SELF LAMINATING WRISTBAND WITH REDUCED IMAGE AREA

(75) Inventors: Sanjay K. Jain, Saint Louis, MO (US); Mark Greer, O'Fallon, MO (US)

(73) Assignee: Laser Band, LLC, Saint Louis, MO (US)

( * ) Notice: Subject to any disclaimer, the term of this patent is extended or adjusted under 35 U.S.C. 154(b) by 535 days.

(21) Appl. No.: 13/030,966

(22) Filed: Feb. 18, 2011

(65) Prior Publication Data

US 2012/0210620 A1 Aug. 23, 2012

(51) Int. Cl.
*A44C 5/00* (2006.01)
*G09F 3/00* (2006.01)

(52) U.S. Cl.
CPC ..... *G09F 3/005* (2013.01)
USPC ..... 40/633; 283/75

(58) Field of Classification Search
USPC ..... 40/633, 665; 283/75, 81
See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |
| 1,383,335 | A | 7/1921 | Penksa |
| 1,517,456 | A | 12/1924 | Pulliam |
| 2,054,227 | A | 9/1936 | Nichols |
| 2,073,280 | A | 3/1937 | Lederer |
| 2,553,676 | A | 5/1951 | Roos |
| 2,641,074 | A | 6/1953 | Richmond |
| 2,687,978 | A | 8/1954 | Vogt |
| 2,914,166 | A | 11/1959 | Bihler |
| 3,153,869 | A | 10/1964 | Twentier |
| 3,197,899 | A | 8/1965 | Twentier |
| 3,402,808 | A | 9/1968 | Yannuzzi |
| 3,517,802 | A | 6/1970 | Petrie |
| 3,585,743 | A | 6/1971 | Jeffers |

(Continued)

FOREIGN PATENT DOCUMENTS

| | | | |
|---|---|---|---|
| CA | 2500438 | A1 | 4/2004 |
| DE | 202009015076 | U1 | 1/2010 |

(Continued)

OTHER PUBLICATIONS

Office Action for CA Application 2567762 dated Mar. 1, 2012.

(Continued)

*Primary Examiner* — Joanne Silbermann
(74) *Attorney, Agent, or Firm* — Alston & Bird LLP

(57) ABSTRACT

A business form comprising a face ply and a lamination ply includes a matrix of self adhering labels positioned in a label area and a self laminating wristband positioned in a wristband area, all of which are defined by die cuts therein for removal upon use. The wristband is comprised of a left edge justified, reduced length imaging area releasably adhered to a laminating portion comprising a pair of laminating panels one of which is smaller sized to merely laminate the imaging area and with self adhering tabs at opposite ends of the panels. A wristband extender is die cut into the lamination ply within the profile of the wristband. A second embodiment includes a pair of separated imaging areas in the same space as the single imaging area along with special precautions labels die cut into the lamination ply for application to the second smaller imaging area. The wristband may be provided separately in an envelope sized sheetlet or in a page size form with multiple wristbands but no labels.

30 Claims, 8 Drawing Sheets

Face Ply View (1)

(56) References Cited

U.S. PATENT DOCUMENTS

| | | | |
|---|---|---|---|
| 3,660,916 | A | 5/1972 | McDermott et al. |
| 3,698,383 | A | 10/1972 | Baucom |
| 3,751,835 | A | 8/1973 | Smith |
| 3,771,717 | A | 11/1973 | McDermott et al. |
| 3,854,229 | A | 12/1974 | Morgan |
| 4,004,362 | A | 1/1977 | Barbieri |
| 4,078,324 | A | 3/1978 | Wiebe |
| 4,142,310 | A | 3/1979 | Groselak et al. |
| 4,179,833 | A | 12/1979 | Knodel |
| 4,226,036 | A | 10/1980 | Krug |
| 4,233,715 | A | 11/1980 | McDermott |
| 4,370,370 | A | 1/1983 | Iwata et al. |
| 4,565,731 | A | 1/1986 | Komatsu et al. |
| 4,612,718 | A | 9/1986 | Golub et al. |
| 4,627,994 | A | 12/1986 | Welsch |
| 4,630,384 | A | 12/1986 | Breen |
| 4,682,431 | A | 7/1987 | Kowalchuk et al. |
| 4,696,843 | A | 9/1987 | Schmidt |
| 4,783,917 | A | 11/1988 | Smith et al. |
| 4,829,604 | A | 5/1989 | Allen et al. |
| 4,854,610 | A | 8/1989 | Kwiatek |
| 4,855,277 | A | 8/1989 | Walter |
| 4,914,843 | A | 4/1990 | DeWoskin |
| 4,941,210 | A | 7/1990 | Konucik |
| 4,950,638 | A | 8/1990 | Yuyama et al. |
| 4,956,931 | A | 9/1990 | Selke |
| D312,654 | S | 12/1990 | Giordano |
| 4,978,144 | A | 12/1990 | Schmidt et al. |
| 4,991,337 | A | 2/1991 | Solon |
| RE33,616 | E | 6/1991 | Welsch |
| 5,026,084 | A | 6/1991 | Pasfield |
| 5,045,426 | A | 9/1991 | Maierson et al. |
| 5,135,789 | A | 8/1992 | Schmidt |
| 5,222,823 | A | 6/1993 | Conforti |
| 5,227,004 | A | 7/1993 | Belger |
| 5,227,209 | A | 7/1993 | Garland |
| 5,283,969 | A | 2/1994 | Weiss |
| 5,311,689 | A | 5/1994 | Lindsey |
| 5,318,326 | A | 6/1994 | Garrison |
| 5,331,140 | A | 7/1994 | Stephany |
| 5,351,993 | A | 10/1994 | Wright et al. |
| 5,370,420 | A | 12/1994 | Khatib et al. |
| 5,381,617 | A | 1/1995 | Schwartztol et al. |
| 5,383,686 | A | 1/1995 | Laurash |
| 5,395,667 | A | 3/1995 | Ohno et al. |
| 5,401,110 | A | 3/1995 | Neeley |
| 5,418,026 | A | 5/1995 | Dronzek, Jr. et al. |
| 5,427,416 | A | 6/1995 | Birch et al. |
| 5,486,021 | A | 1/1996 | Laurash |
| 5,486,436 | A | 1/1996 | Lakes |
| 5,509,693 | A | 4/1996 | Kohls |
| 5,509,694 | A | 4/1996 | Laurash et al. |
| 5,518,787 | A | 5/1996 | Konkol |
| 5,524,934 | A | 6/1996 | Schwan et al. |
| 5,547,227 | A | 8/1996 | Laurash et al. |
| 5,560,657 | A | 10/1996 | Morgan |
| 5,581,924 | A | 12/1996 | Peterson |
| 5,586,788 | A | 12/1996 | Laurash |
| 5,595,404 | A | 1/1997 | Skees |
| 5,596,202 | A | 1/1997 | Arakawa |
| 5,598,970 | A | 2/1997 | Mudry et al. |
| 5,601,222 | A | 2/1997 | Haddad |
| 5,601,313 | A | 2/1997 | Konkol et al. |
| 5,630,627 | A | 5/1997 | Stewart |
| 5,637,369 | A | 6/1997 | Stewart |
| 5,648,143 | A | 7/1997 | Mehta et al. |
| 5,653,472 | A | 8/1997 | Huddleston et al. |
| 5,662,976 | A | 9/1997 | Popat et al. |
| 5,670,015 | A | 9/1997 | Finestone et al. |
| 5,687,903 | A | 11/1997 | Akridge et al. |
| D391,991 | S | 3/1998 | Conner |
| 5,765,885 | A | 6/1998 | Netto et al. |
| 5,785,354 | A | 7/1998 | Haas |
| 5,842,722 | A | 12/1998 | Carlson |
| 5,877,742 | A | 3/1999 | Klink |
| 5,933,993 | A | 8/1999 | Riley |
| 5,984,363 | A | 11/1999 | Dotson et al. |
| 6,000,160 | A | 12/1999 | Riley |
| 6,006,460 | A | 12/1999 | Blackmer |
| 6,016,618 | A | 1/2000 | Attia et al. |
| D423,044 | S | 4/2000 | Burke et al. |
| 6,053,535 | A | 4/2000 | Washburn et al. |
| 6,055,756 | A | 5/2000 | Aoki |
| 6,058,639 | A | 5/2000 | Tinklenberg et al. |
| 6,067,739 | A | 5/2000 | Riley |
| 6,071,585 | A | 6/2000 | Roth |
| 6,092,321 | A | 7/2000 | Cheng et al. |
| 6,108,876 | A | 8/2000 | Hubbert |
| 6,155,476 | A | 12/2000 | Fabel |
| 6,155,603 | A | 12/2000 | Fox |
| 6,159,570 | A | 12/2000 | Ulrich et al. |
| 6,199,730 | B1 | 3/2001 | Chisolm |
| D448,404 | S | 9/2001 | Hamilton et al. |
| 6,303,539 | B1 | 10/2001 | Kosarew |
| 6,331,018 | B1 | 12/2001 | Roth et al. |
| 6,343,819 | B1 | 2/2002 | Shiozaki |
| 6,361,078 | B1 | 3/2002 | Chess |
| 6,364,366 | B1 | 4/2002 | Schwartz |
| 6,409,871 | B1 | 6/2002 | Washburn et al. |
| 6,438,881 | B1 | 8/2002 | Riley |
| 6,510,634 | B1 | 1/2003 | Riley |
| 6,517,921 | B2 | 2/2003 | Ulrich et al. |
| D473,264 | S | 4/2003 | Sanford et al. |
| 6,611,962 | B2 | 9/2003 | Redwood et al. |
| 6,641,048 | B1 | 11/2003 | Schintz et al. |
| 6,685,228 | B2 | 2/2004 | Riley |
| 6,748,687 | B2 | 6/2004 | Riley |
| 6,782,648 | B1 | 8/2004 | Mosher, Jr. |
| 6,807,680 | B2 | 10/2004 | Sloot |
| 6,836,215 | B1 | 12/2004 | Laurash et al. |
| 6,844,041 | B2 | 1/2005 | Squier et al. |
| D503,197 | S | 3/2005 | Stewart et al. |
| 6,863,311 | B2 | 3/2005 | Riley |
| 6,971,200 | B2 | 12/2005 | Valenti, Jr. |
| 6,981,948 | B2 | 1/2006 | Pellegrino et al. |
| 7,017,293 | B2 | 3/2006 | Riley |
| 7,017,294 | B2 | 3/2006 | Riley |
| D521,565 | S | 5/2006 | Stewart et al. |
| 7,047,682 | B2 | 5/2006 | Riley |
| 7,197,842 | B2 | 4/2007 | Ali |
| 7,222,448 | B2 | 5/2007 | Riley |
| 7,240,446 | B2 | 7/2007 | Bekker |
| 7,286,055 | B2 | 10/2007 | Girvin et al. |
| 7,386,949 | B2 * | 6/2008 | Riley ..... 40/633 |
| 7,523,576 | B1 | 4/2009 | Petty |
| D611,984 | S | 3/2010 | Ali et al. |
| 7,763,344 | B2 | 7/2010 | Riley et al. |
| 7,779,569 | B2 | 8/2010 | Riley et al. |
| 7,779,570 | B2 | 8/2010 | Riley |
| 7,784,209 | B2 | 8/2010 | Greer |
| 7,784,210 | B2 | 8/2010 | Riley et al. |
| 7,818,908 | B2 | 10/2010 | Greer |
| 7,823,310 | B2 | 11/2010 | Jain et al. |
| 7,877,915 | B2 | 2/2011 | Jain et al. |
| 7,883,018 | B2 | 2/2011 | Riley et al. |
| 7,918,045 | B2 | 4/2011 | Riley |
| D640,738 | S | 6/2011 | Jain et al. |
| 8,006,422 | B2 | 8/2011 | Riley |
| 8,011,125 | B2 | 9/2011 | Riley et al. |
| 8,074,389 | B2 | 12/2011 | Greer et al. |
| 8,099,888 | B2 | 1/2012 | Riley |
| 8,109,021 | B2 | 2/2012 | Jain et al. |
| 2002/0152928 | A1 | 10/2002 | Lawandy et al. |
| 2002/0176973 | A1 | 11/2002 | Keiser |
| 2003/0001381 | A1 | 1/2003 | Riley |
| 2003/0003249 | A1 | 1/2003 | Benim et al. |
| 2003/0011190 | A1 | 1/2003 | Ryan |
| 2003/0028136 | A1 | 2/2003 | Stager |
| 2004/0060216 | A1 | 4/2004 | Riley |
| 2004/0068906 | A1 | 4/2004 | Riley |
| 2004/0128892 | A1 | 7/2004 | Valenti |
| 2004/0148836 | A1 | 8/2004 | Riley |
| 2004/0244251 | A1 | 12/2004 | Riley |
| 2005/0091896 | A1 | 5/2005 | Kotik et al. |

(56) References Cited

U.S. PATENT DOCUMENTS

| | | | | |
|---|---|---|---|---|
| 2005/0108912 | A1 | 5/2005 | Bekker | |
| 2005/0279001 | A1 | 12/2005 | Riley | |
| 2005/0281989 | A1 | 12/2005 | Finger | |
| 2006/0143961 | A1* | 7/2006 | Riley | 40/633 |
| 2006/0230661 | A1 | 10/2006 | Bekker | |
| 2006/0236578 | A1 | 10/2006 | Saint et al. | |
| 2006/0242875 | A1 | 11/2006 | Wilson et al. | |
| 2006/0261958 | A1 | 11/2006 | Klein | |
| 2007/0089342 | A1 | 4/2007 | Jain et al. | |
| 2007/0120358 | A1 | 5/2007 | Waggoner et al. | |
| 2007/0220796 | A1 | 9/2007 | Riley et al. | |
| 2007/0243361 | A1 | 10/2007 | Riley et al. | |
| 2007/0257113 | A1 | 11/2007 | Davis et al. | |
| 2008/0098636 | A1 | 5/2008 | Greer | |
| 2009/0031602 | A1 | 2/2009 | Riley | |
| 2009/0094872 | A1 | 4/2009 | Ali et al. | |
| 2009/0094873 | A1 | 4/2009 | Riley | |
| 2009/0193701 | A1 | 8/2009 | Greer | |
| 2009/0277061 | A1 | 11/2009 | Jain et al. | |
| 2009/0282717 | A1 | 11/2009 | Jain et al. | |
| 2010/0071241 | A1 | 3/2010 | Jain et al. | |
| 2010/0253060 | A1 | 10/2010 | Riley et al. | |
| 2010/0281724 | A1 | 11/2010 | Greer et al. | |
| 2011/0000114 | A1 | 1/2011 | Riley et al. | |

FOREIGN PATENT DOCUMENTS

| | | | |
|---|---|---|---|
| DE | 202009015077 | U1 | 1/2010 |
| EP | 1039431 | | 9/2000 |
| EP | 1111568 | A1 | 6/2001 |
| EP | 1974603 | | 10/2008 |
| FR | 2806594 | | 9/2001 |
| GB | 960859 | | 6/1964 |
| GB | 2045718 | | 11/1980 |
| GB | 2160492 | | 12/1985 |
| GB | 2228915 | | 9/1990 |
| JP | 61011047 | A | 1/1986 |
| JP | 63175913 | A | 11/1988 |
| JP | 5-61777 | | 8/1993 |
| JP | 08-190350 | | 7/1996 |
| JP | 08299035 | | 11/1996 |
| JP | 3032299 | | 12/1996 |
| JP | 10-207374 | | 8/1998 |
| JP | 2001316921 | A | 11/2001 |
| JP | 2002117190 | A | 4/2002 |
| JP | 2002351321 | A | 12/2002 |
| JP | 2002363808 | A | 12/2002 |
| JP | 2003066849 | | 3/2003 |
| JP | 2003157010 | | 5/2003 |
| JP | 2003164307 | A | 6/2003 |
| JP | 2006-501526 | A | 1/2006 |
| JP | 2006039209 | | 2/2006 |
| KG | 11015383 | | 1/1999 |
| WO | 95/02877 | | 1/1995 |
| WO | 96/12618 | | 5/1996 |
| WO | 98/23081 | | 5/1998 |
| WO | 99/18817 | | 4/1999 |
| WO | 02/39412 | | 5/2002 |
| WO | 03/003331 | | 1/2003 |
| WO | 2004/028826 | | 4/2004 |
| WO | 2005/064574 | | 7/2005 |
| WO | 2006/007356 | | 1/2006 |
| WO | 2007/021375 | | 2/2007 |
| WO | 2007/133906 | | 11/2007 |
| WO | 2008/079952 | A2 | 7/2008 |
| WO | 2009099787 | A1 | 8/2009 |
| WO | 2009/137195 | | 11/2009 |
| WO | 2010129131 | | 11/2010 |
| WO | 2012/112268 | A1 | 8/2012 |

OTHER PUBLICATIONS

Office Action for CN Application 200980102244.8 dated Jan. 18, 2012.
Office Action for CA Application 2667271 dated Oct. 27, 2011.
Office Action for CN Application 03825215.5 dated Nov. 2, 2011.
Office Action for U.S. Appl. No. 11/373,923 dated Jan. 21, 2010.
Office Action for U.S. Appl. No. 11/373,923 dated Jul. 13, 2010.
Office Action for U.S. Appl. No. 11/373,923 dated Jun. 1, 2009.
Office Action for U.S. Appl. No. 11/374,273 dated May 26, 2009.
Office Action for U.S. Appl. No. 11/405,149 dated Dec. 28, 2009.
Office Action for U.S. Appl. No. 11/455,131 dated Mar. 9, 2010.
Office Action for U.S. Appl. No. 11/456,928 dated Dec. 8, 2009.
Office Action for U.S. Appl. No. 11/456,928 dated Jun. 15, 2009.
Office Action for U.S. Appl. No. 11/553,872 dated Jun. 17, 2009.
Office Action for U.S. Appl. No. 11/553,891 dated Mar. 19, 2009.
Office Action for U.S. Appl. No. 11/553,891 dated Mar. 8, 2010.
Office Action for U.S. Appl. No. 11/562,114 dated May 6, 2009.
Office Action for U.S. Appl. No. 11/735,078 dated May 28, 2009.
Office Action for U.S. Appl. No. 11/735,078 dated Nov. 17, 2009.
Office Action for U.S. Appl. No. 11/754,812 dated Feb. 9, 2010.
Office Action for U.S. Appl. No. 11/754,812 dated Jul. 24, 2009.
Office Action for U.S. Appl. No. 11/763,615 dated Jan. 22, 2010.
Office Action for U.S. Appl. No. 11/763,615 dated May 6, 2009.
Office Action for U.S. Appl. No. 12/026,030 dated Dec. 9, 2010.
Office Action for U.S. Appl. No. 12/026,030 dated Oct. 8, 2009.
Office Action for U.S. Appl. No. 12/115,945 dated Aug. 9, 2010.
Office Action for U.S. Appl. No. 12/252,654 dated Aug. 12, 2010.
Office Action for U.S. Appl. No. 12/252,710 dated Jun. 10, 2010.
Office Action for U.S. Appl. No. 12/252,710 dated Oct. 15, 2009.
Office Action for U.S. Appl. No. 12/435,541 dated Jul. 7, 2010.
Office Action for U.S. Appl. No. 12/435,541 dated Oct. 29, 2010.
Office Action for U.S. Appl. No. 12/509,151 dated Nov. 13, 2009.
Office Action for U.S. Appl. No. 12/819,709 dated Aug. 19, 2010.
Office Action for U.S. Appl. No. 12/819,709 dated Nov. 8, 2010.
Office Action for U.S. Appl. No. 12/847,271 dated Mar. 31, 2011.
Office Action for U.S. Appl. No. 11/455,131 dated Aug. 31, 2010.
Office Action for U.S. Appl. No. 11/456,928 dated Jun. 8, 2010.
Office Action for U.S. Appl. No. 12/627,227 dated Aug. 31, 2010.
Patent Cooperation Treaty; Partial International Search Report; May 24, 2005.
Patent Cooperation Treaty; Partial International Search Report; Sep. 13, 2004.
Posey Movable I.D. Bracelet; downloaded from http:/www.posey.com/products/4648.html on Aug. 18, 2004.
Sample of Standard Register Label, date unknown.
Sample of Standard Register Labels, date unknown.
Standard Register, P.S. Magazine, Fall 1998, Dayton, Ohio.
International Preliminary Report on Patentability (Chapter II) for PCT/US2010/030361 issued May 13, 2011.
Office Action for U.S. Appl. No. 11/373,923 dated May 17, 2011.
Office Action for U.S. Appl. No. 12/115,945 dated Jun. 2, 2011.
International Search Report and Written Opinion for PCT/US2012/022472 dated Apr. 24, 2012.
Office Action for IN Application 4633/CHENP/2006 dated Apr. 9, 2012.
Office Action for JP Application 2008-526005 dated Apr. 3, 2012.
Office Action for JP Application 2010-510465 dated Mar. 21, 2012.
Office Action for EP Application 06785676.5 dated Jul. 22, 2011.
Office Action for JP Application 2006-547497 dated May 17, 2011.
Office Action for JP Application 2007-516565 dated May 17, 2011.
Office Action for U.S. Appl. No. 12/847,271 dated Jun. 28, 2011.
Office Action for AU 2008260168 dated Sep. 17, 2012.
Office Action for CA Application 2549631 dated Jul. 23, 2012.
Office Action for CA Application 2667271 dated Aug. 9, 2012.
Office Action for CA Application 2717452 dated Jul. 3, 2012.
Office Action for CA Application No. 2679181 dated Jul. 19, 2012.
Office Action for CN Application 200880017803.0 dated Aug. 29, 2012.
Office Action for JP Application 2011-14903 dated Jun. 26, 2012.
Office Action for JP Application 2011-508529 dated Jul. 3, 2012.
Office Action for JP Application No. 2010-248676 dated Jun. 12, 2012.
Office Action for AU Application 2008260168 dated Aug. 26, 2011.
Office Action for CA Application 2549631 dated Sep. 9, 2011.
Office Action for CA Application 2679181 dated Sep. 2, 2011.
Office Action for CN Application 200880017803.0 dated Aug. 26, 2011.

(56) References Cited

OTHER PUBLICATIONS

Office Action for U.S. Appl. No. 11/373,923 dated Aug. 12, 2011.
Office Action for U.S. Appl. No. 12/115,945 dated Aug. 19, 2011.
Office Action for U.S. Appl. No. 12/435,541 dated Aug. 19, 2011.
Extended European Search Report for EP 11177147.3 dated Jan. 17, 2012.
Office Action for JP Application 2011-14903 dated Dec. 28, 2011.
"Yes, Sir, That's My Baby!," Material Management in Health Care, Feb. 1999, vol. 8, No. 2, Health Forum, Inc.
Avery Laminated Identification Cards #5361, date unknown.
Avery Dennison DuraCard, date unknown.
Brochure entitled: "Integrated Document Management Software"; Smead Manufacturing Company; Date Unknown; Form No. SLI-95.
Brochure entitled: "Color-Bar a Folders"; Smead Manufacturing Company; Date Unknown.
Brochure entitled: "Color-Bara—Click Stripa Labeling System"; Smead Manufacturing Company; Date Unknown; Form No. SSS-CS-00.
Catalog entitled: "Reseller Catalog Number One"; Smead Software Solutions ; Date Unknown; Form No. SSS-RC1-00.
Disaster Management Systems, Inc., Triage Tag, Copyright 1996, Pomona, California.
Final Office Action for U.S. Appl. No. 11/735,078 dated Jul. 23, 2010.
Final Office Action for U.S. Appl. No. 12/026,030 dated Jun. 28, 2010.
Gretchen Berry, "Wrist Watch," Advance for Healthcare Information Professionals, Feb. 15, 1999.
ID Warehouse (http://web.archive.org/web/20050131235601/http://idwarehouse.com/) Jan. 31, 2005. p. 1: WB1908, Stock Vinyl Wristband.
International Preliminary Report on Patenability (Chapter II) for PCT/US2009/031979 issued May 21, 2010.
International Preliminary Report on Patentability (Chapter I) for PCT/US2008/064972 dated Dec. 1, 2009.
International Preliminary Report on Patentability (Chapter II) for PCT/US2008/059616 dated Jul. 14, 2009.
International Preliminary Report on Patentability (Chapter II) for PCT/US2009/039183 issued Apr. 20, 2010.
International Search Report and Written Opinion for PCT/US2010/030361 dated Jul. 16, 2010.
International Search Report for PCT/US2009/031979 dated Mar. 9, 2009.
International Search Report for PCT/US2009/039183 dated Jun. 25, 2009.
Maryland Department of Transportation, Maryland Emergency Medical Services, Triage Tag, Copyright MIEMMS 1999, Maryland.
Office Action for AU Application 2006280450 dated Aug. 31, 2010.
Office Action for AU Application 2006280450 dated Sep. 14, 2009.
Office Action for AU Application 2007238028 dated Apr. 19, 2010.
Office Action for AU Application 2007317692 dated Aug. 12, 2010.
Office Action for AU Application No. 2008202215 dated Dec. 15, 2009.
Office Action for CA Application 2427249 dated Mar. 4, 2010.
Office Action for CA Application 2549631 dated Nov. 25, 2010.
Office Action for CA Application 2567762 dated Apr. 11, 2011.
Office Action for CA Application 2667271 dated Dec. 30, 2010.
Office Action for CA Application 2667273 dated Dec. 29, 2010.
Office Action for CA Application 2679181 dated Nov. 19, 2010.
Office Action for CN Application 03825215.5 dated Aug. 30, 2010.
Office Action for CN Application 03825215.5 dated Dec. 29, 2010.
Office Action for CN Application 03825215.5 dated Jan. 8, 2010.
Office Action for CN Application 200580019868.5 dated Sep. 4, 2009.
Office Action for CN Application 200680035179.8 dated Apr. 1, 2011.
Office Action for EP Application 01993920.6 dated Dec. 29, 2010.
Office Action for EP Application 03773060.3 dated Apr. 6, 2011.
Office Action for EP Application 03773060.3 dated Aug. 11, 2009.
Office Action for EP Application 03773060.3 dated Aug. 30, 2010.
Office Action for EP Application 04818089.7 dated Dec. 21, 2010.
Office Action for EP Application 05757812.2 dated Dec. 28, 2010.
Office Action for EP Application 07842781.2 dated Oct. 25, 2010.
Office Action for EP Application 07842813.3 dated Feb. 4, 2010.
Office Action for JP Application 2005-501996 dated Jul. 6, 2010.
Office Action for JP Application 2007-516565 dated Jul. 13, 2010.
Office Action for JP Application No. 2006-547497 dated Mar. 23, 2010.
Office Action for NZ Application 566071 dated May 7, 2010.
Office Action for U.S. Appl. No. 11/203,601 dated Aug. 17, 2009.
Office Action for U.S. Appl. No. 11/203,601 dated Mar. 30, 2010.

* cited by examiner

FIG. 1 Face Ply View (1)

FIG. 2 Face Ply View (2)

FIG. 3 Die cut layout, Black = face ply, Red = laminate ply

FIG. 4 Wristband Layout

FIG. 5 Silicone Layer

FIG. 6 Laminate Layer View

BUSINESS FORM WITH SELF LAMINATING WRISTBAND WITH REDUCED IMAGE AREA

BACKGROUND AND SUMMARY OF THE INVENTION

Self laminating wristbands of various inventive designs have been made and sold, and achieved immense commercial success, by the assignee of the present invention. Many of these have been patented by the assignee including those covered by one or more of U.S. Pat. Nos. 6,000,160, 6,748,687, 7,047,682, 7,017,293, 7,654,024, 7,763,344, 7,779,569, and others of record assigned to the assignee hereof, the disclosures of which are incorporated herein by reference. In its continuing efforts to develop improved wristbands to meet the varying needs of its customers and users, the inventors herein have succeeded in designing and inventing a new self laminating wristband which incorporates many of the same advantages of previous designs but which also provides significant new advantages and features.

Perhaps the first of the assignee's patented wristbands includes a full length image or imaging area adhered to one of a pair of aligned, full length, symmetrical and mirror image lamination panels, each of said lamination panels including a shorter, narrower tab for securing the wristband around a patient's wrist. Upon separation of the wristband from a carrier sheet, the lamination panels are folded over and adhered to each other to laminate the image area. Then the wristband is wrapped around the patient's wrist and secured with one or both of the tabs.

Another of the assignee's many previously patented wristbands that has met with tremendous commercial success incorporates a reduced length image area adhered to one of a pair of laminating clamshells. One of the laminating clamshell halves has a strap and a cinch slot is die cut into both the clamshell halves opposite the strap so that after separation from the carrier the wristband and lamination of the image area, it may be secured by wrapping the strap around the patient's wrist and then threading it through the slot, adhering the end of the strap back onto itself to complete the process. One of the advantages of this design is that by using a shorter lamination clamshell with a strap extending from just one of the clamshell halves in place of the full length lamination panels, space becomes available for a wristband extender to be die cut into the space otherwise occupied by the full length lamination panels of the above described earlier design.

While this newer design form and wristband has many advantages which make it attractive for adoption in new installations, adapting it for use in installations using the assignee's (and others) previous designs requires re-programming, reformatting, and possibly other printer changes to ensure that the printed information reliably lands on the differently sized and located image area. This retrofit thus requires some effort and expense and also raises the possibility of transition issues. For these reasons, among others, once an installation is set up and running, there is a reluctance to change despite the advantages of newer design wristbands and forms, one of which is the extender provided by the newer clamshell design. And, unfortunately, there has been an experienced shift in the population towards increasing body weight and even obesity in not just the US but around the world. Thus, the availability of a wristband extender is increasingly important to be able to properly secure the wristband to a patient's wrist.

In use, it has been found that in many existing installations using assignee's earlier wristband design, with the full length image area and short end tabs, printed information is generally formatted to be left margin justified (or could readily be left margin justified) and ordinarily does not utilize nearly the full length of the image area, leaving a goodly portion of the image area blank and unused. Thus, while this wristband maximizes the amount of image area available for printing, in practice a good deal of it is unused, and typically in many cases it's the right side that's predominantly left blank. Yet another issue found in practical application of this wristband is that it is symmetrical after being laminated so that a health care professional could choose to wrap either end over the top of the wristband to secure it around the wrist. Unfortunately, if the wrong end is wrapped over the top of the other end, there is a chance that it would cover over and obscure the printed information. This is possible because the wristband is symmetrical so that memory must be relied upon to choose which end to wrap first. While not a serious issue, and especially for more experienced health care professionals, this can result in some wastage and required re-printing of the wristband.

The inventors herein have succeeded in inventing a wristband form that combines many of the advantages of both designs which can be conveniently used as a "no-transition-issue" retrofit for existing installations and which also frees space in the wristband area of the form for a wristband extender. This newest inventive design incorporates a reduced length image area with one reduced length lamination panel along with self adhering tabs to attach the wristband, with the image area (and a lamination panel) being "edge justified" to the left margin so that most left justified printer installations need not be modified. In other words, the image area and one of the lamination panels are truncated at their right side to be shorter than the other lamination panel, but otherwise aligned with the mating lamination panel for lamination of the image area. Many installations print two blocks of information: one block with patient/Doctor id information in standard text and a second block with a printed bar code. Typically, these two blocks may be separated to enhance reading accuracy. While margins at the left edge and between these two blocks may extend the overall length occupied from the left edge, the relative spacing of this information is usually readily adjusted with simple software entries so that both blocks may be conveniently re-located to fit within a nominal four inch long image area. Thus, it is anticipated by the inventors that most previous installations may readily be transitioned to this new wristband.

As the lamination panels are of different length, the wristband is asymmetrical with a single ply lamination strap/tab extending to only one side. Furthermore, by applying the adhesive to the bottom of the tab adjacent the image area and to the top of the tab at the opposite strap end, these tabs are naturally usable when the strap end of the wristband is brought underneath the image area, so that the adhesive coated tab surfaces face each other or some other part of the wristband, thereby ensuring that the wristband is wrapped properly around the wrist to not cover or obscure the printed information. Stated another way, it is natural to not wrap the strap end over the top of the printed area in this design while it was not intuitively obvious which end wrapped under the other in the earlier design as both ends looked the same. This asymmetrical design thus helps to eliminate any possible confusion about how to apply the wristband to the patient's wrist.

By making one lamination panel shorter than the other, space adjacent to the shorter lamination panel is freed for another die cut in the lamination ply to define a wristband extender. Actually, preferably, the die cut defining the wristband extender is within the "profile" of the wristband in that in it fits within the height and width of the overall dimensions of the wristband, thus not extending either of the height or width of the wristband area of the form. This ensures that no "real estate" is lost which might encroach on the label area to reduce the number of labels in the single sheet business form.

The image area of this invention is preferably releasably adhered to its lamination panel so that another label may be conveniently substituted for it before it's laminated, thereby making the wristband more versatile. Furthermore, when the wristband is separated from the form and laminated, the wristband forms an ovoid which helps the laminated image area stay centered atop the patient's wrist. This is facilitated by making the image area shorter than the circumference of the typical adult patient wrist.

This inventive wristband design may also be provided in a separated image area format, thereby providing two (or more) separate image areas. Along with this feature, a number of "special precautions" labels may be provided, die cut into the lamination ply and possibly colored, which increases the flexibility of the wristband for use on patients subject to those special situations.

While the principal advantages and features of this invention have been briefly summarized above, a fuller understanding may be attained by referring to the drawings and description of the preferred embodiments below.

DETAILED DESCRIPTION OF THE PREFERRED EMBODIMENTS

Figure 1:
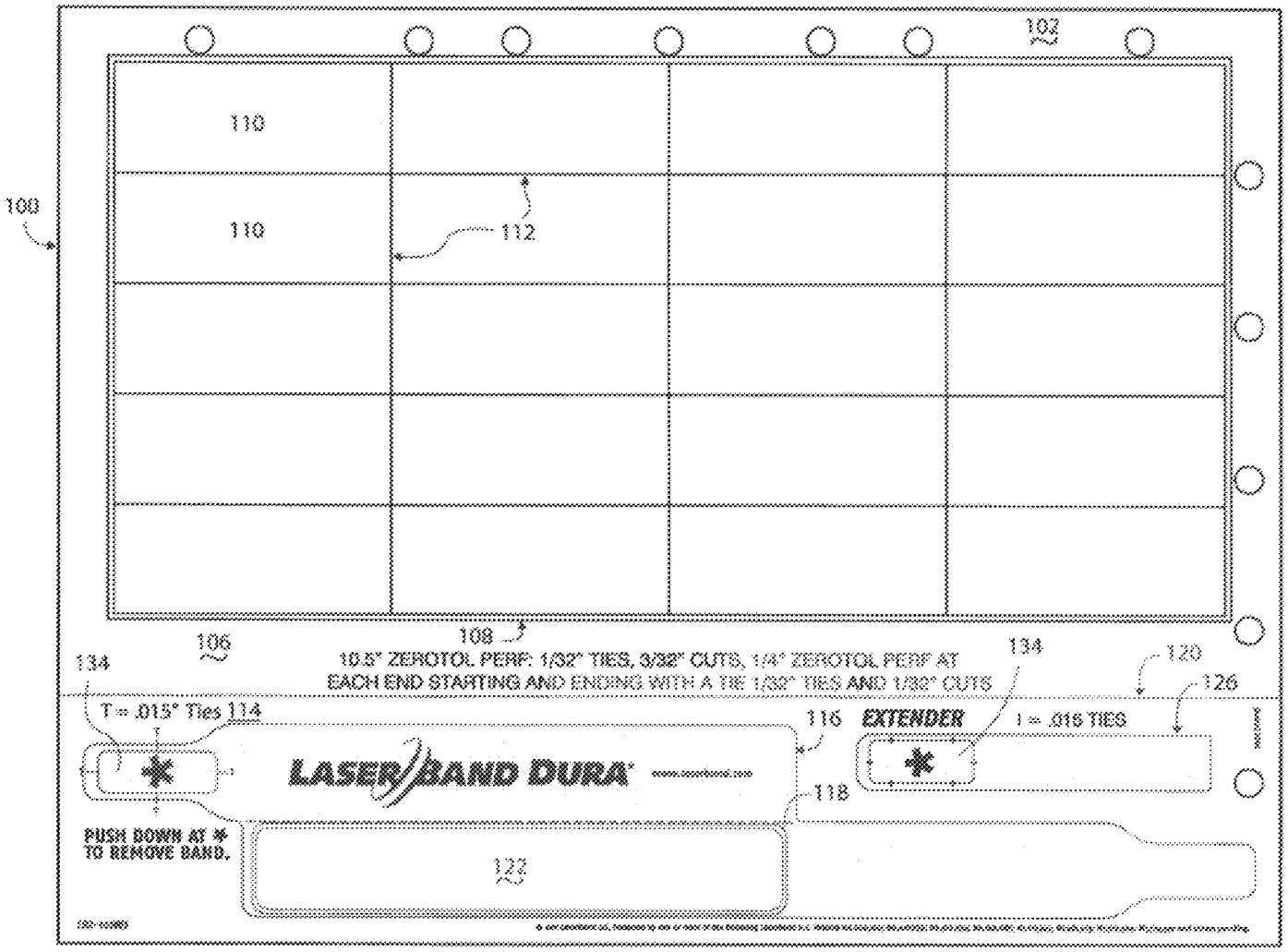
FIG. 1 is a plan view of a first embodiment of the business form of the present invention, depicting the wristband area and the label area die cut into a top face play.
Figure 2:
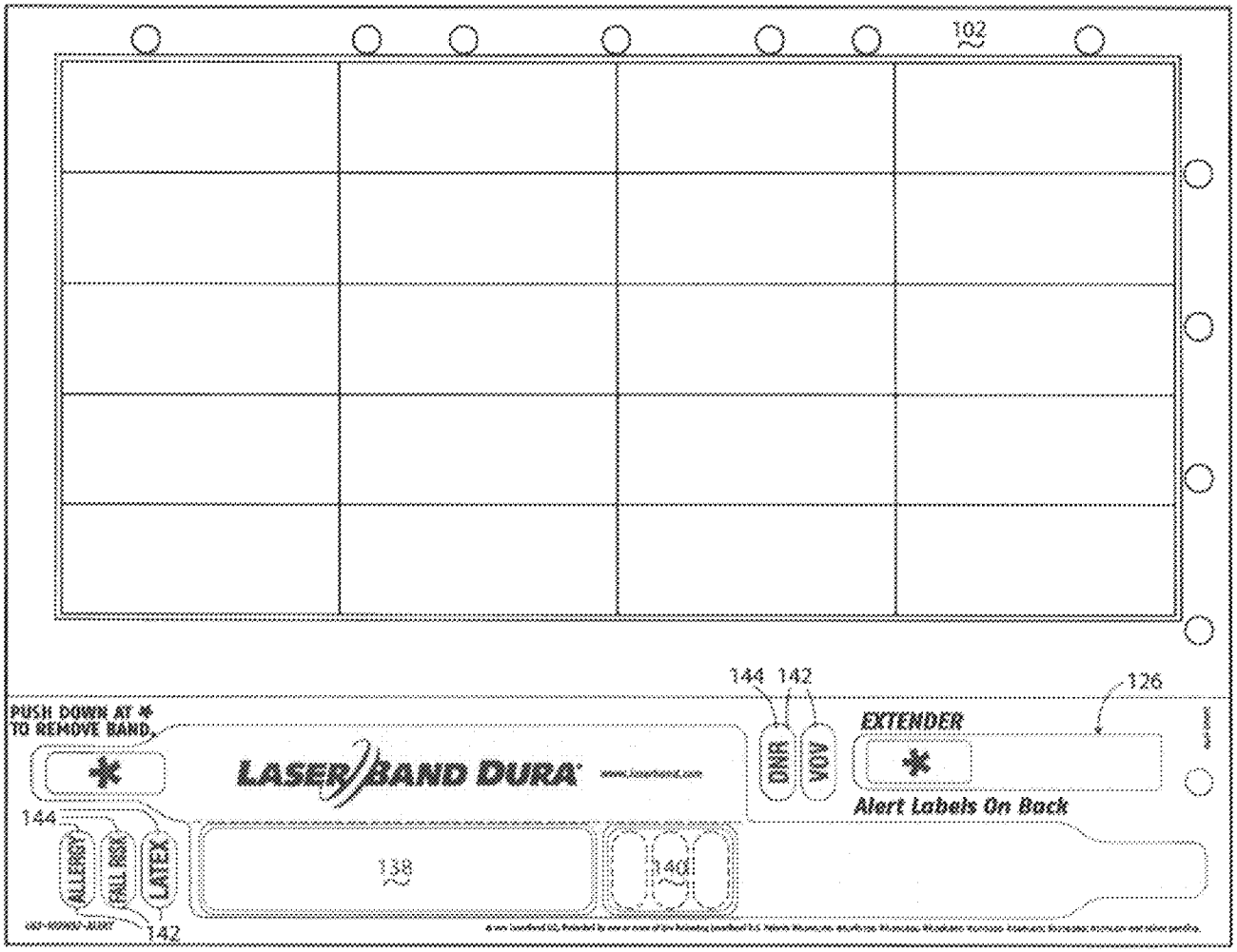
FIG. 2 is a plan view of a second embodiment of the business form of the present invention, depicting the same two areas but with a wristband having a separated image area with special precautions labels.
Figure 7:
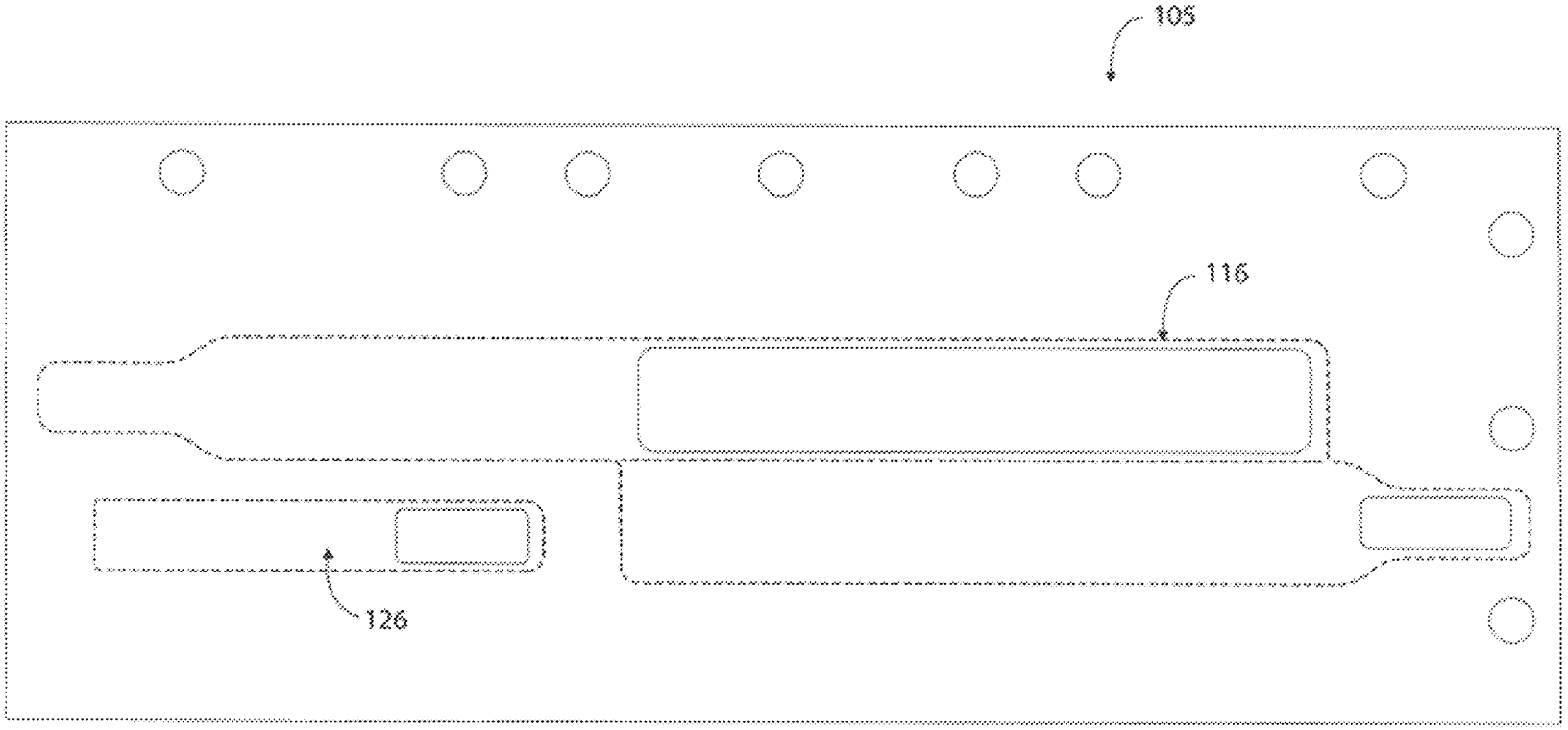
FIG. 7 is a plan view of an envelope sized sheetlet with a wristband and wristband extender die cut therein.
Figure 8:
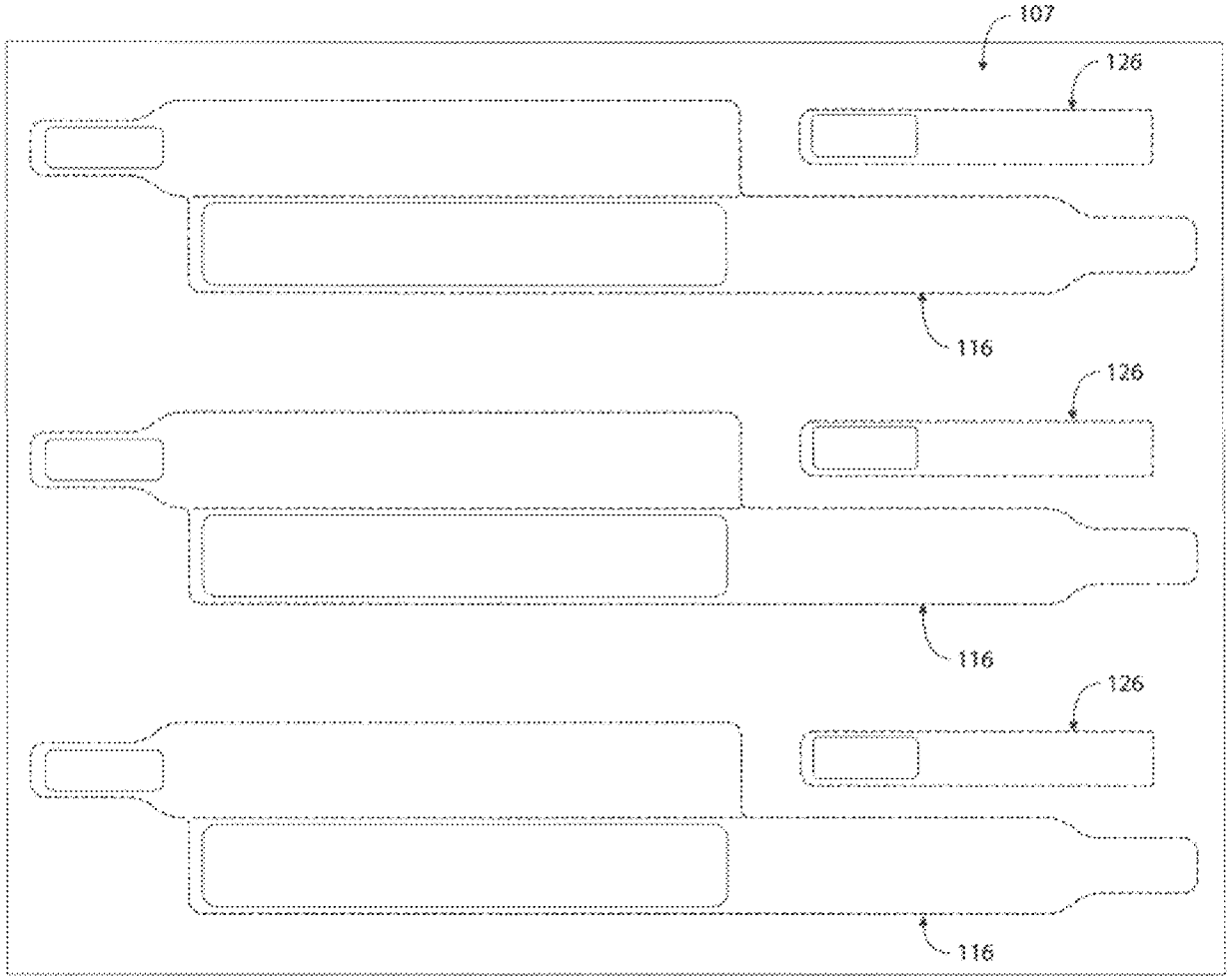
FIG. 8 is a plan view of a page sized business form with three pairs of a wristband and wristband extender die cut therein.

The business form 100 of the present invention is depicted in the plan view of FIG. 1 as being preferably a "page" which can measure any standard or non-standard size, shown nominally in an 8½ inch by 11 inch size format for purposes of illustration only. However, the business form of the present invention may be provided in other sizes such as A4, 11×17 inches, etc. Also, the wristband area 114 may be separately provided in sheetlet format 105 such as by separating the wristband area along the line of perforation 120 or as depicted in FIG. 7, or a page sized business form 107 may be provided with multiple wristbands and without labels or a label area as depicted in FIG. 8. The wristbands 116 and wristband extenders 126 may be of either embodiment, as depicted in FIG. 2 and as explained below in greater detail.

Figure 3:
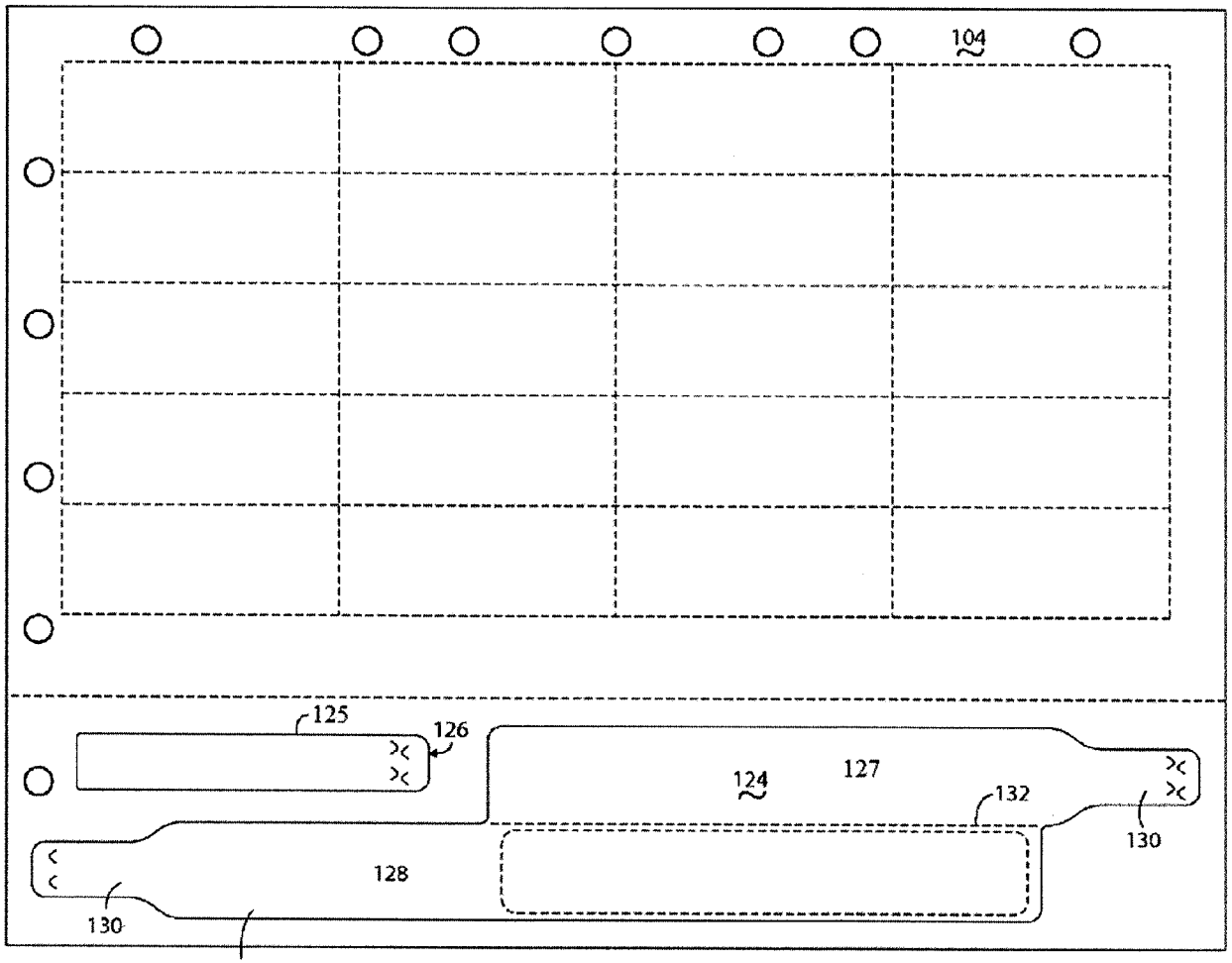
FIG. 3 is a plan view of the bottom, laminate ply with die cuts defining the wristband extender and wristband lamination ply.
Figure 4:
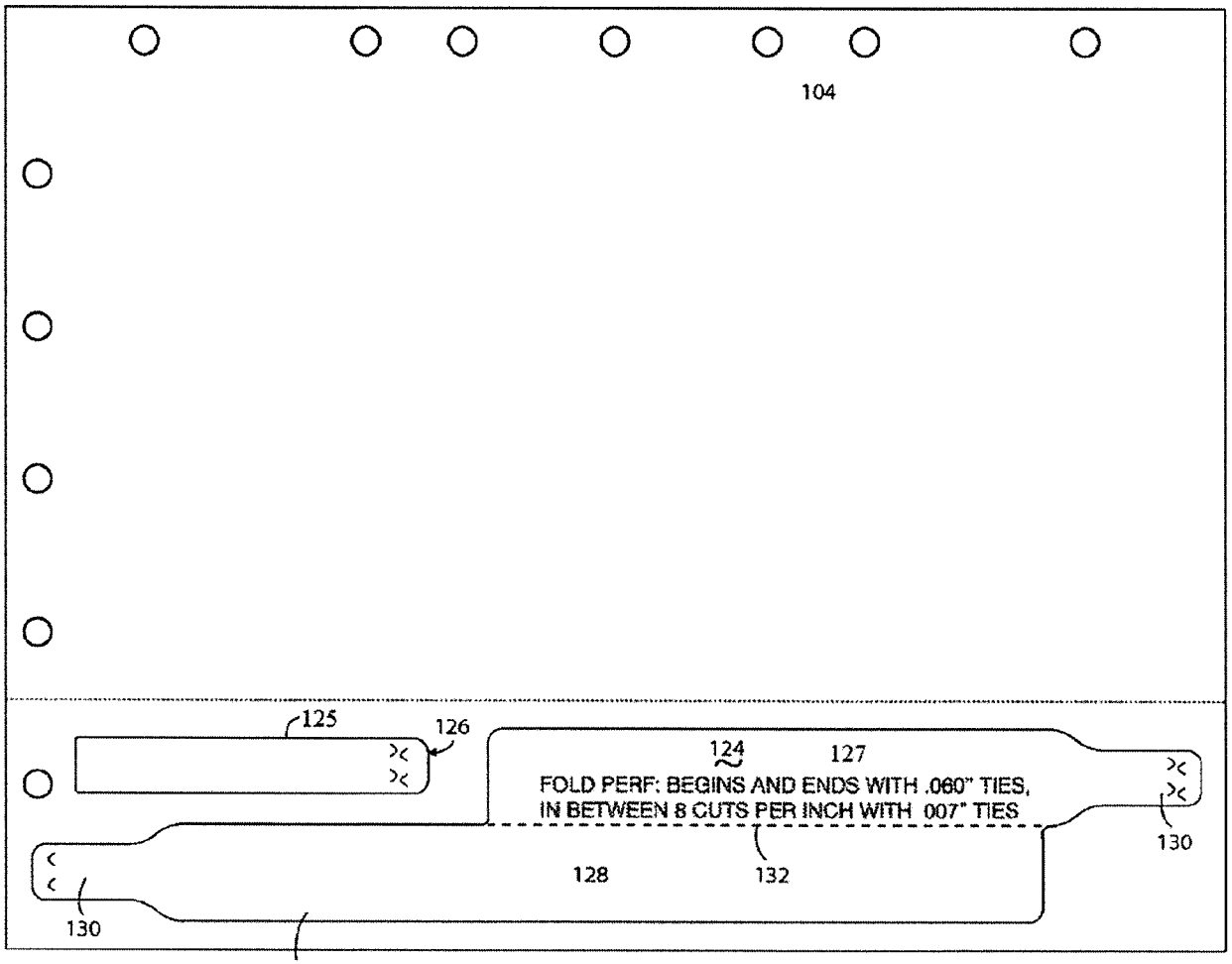
FIG. 4 is a plan view of the bottom, laminate ply detailing the wristband die cut.

The business form 100 of the present invention is preferably a two ply form with an upper face ply 102 adhered with a pattern adhesive to a lower laminate ply 104. The face ply depicted in FIG. 1 comprises an upper label area 106 having a matrix 108 of self adhering labels 110 defined by a plurality of die cuts 112 as is known in the art and a lower wristband area 114 including a self laminating wristband 116 defined by a plurality of die cuts 118 in both plies 102, 104, said upper label area 106 being separated from the lower wristband area 114 by a line of perforation 120. Each label 110 may be individually removed from the form 100 and, once printed with identifying information, separated and applied to charts, etc. to identify their association with a patient. The wristband 116 includes an imaging area 122 defined by a die cut 118 in the face ply 102 which is releasably adhered to an underlying laminating portion 124 (see FIGS. 3, 4) defined by a die cut in the laminate ply 104. Also depicted is a wristband extender 126 defined by a die cut 128 in the laminate ply 104.

In the first embodiment depicted in FIGS. 1, 3, 4, 5, 7, and 8 the wristband 116 includes a laminating portion 124 comprised of a pair of different length laminating panels 127, 128, with panel 127 being sized to merely overlap and laminate the imaging area 122 after separation of the wristband 116. By "merely laminate" is meant that the panel 127 is sufficient to approximate the dimensions of the imaging area 122, and preferably although not absolutely necessarily slightly larger in each dimension so as to form a window frame pattern completely surrounding and encapsulating the imaging area 122 when laminated. An integrally formed, adhesive coated tab 130 extends from opposing ends of the two laminating panels 127, 128 which are used to apply the wristband 116 to a patient's wrist or other appropriate extremity. The extended length of laminating panel 128 effectively forms a strap 129 which bridges the laminated imaging area 122 to the associated tab 130. Preferably, a fold line 132 separates the two laminating panels 127, 128 to aid in folding the shorter top panel 127 over to laminate the imaging area 122 after separation of the wristband 116 from the wristband area 114. Ignoring the tabs 130, the panels 126, 128 are substantially aligned at their left ends so that the imaging area 122 is properly laminated when the panels are folded along the fold line 132. As its preferred embodiment, the imaging area 122 may be approximately 4¾ inches long, laminating panel 127 may be approximately 5 inches long, and laminating panel 128 approximately 7⅞ inches long, ignoring the tab 130 length. These are approximate dimensions and one of ordinary skill might adjust these and yet remain within the scope of the invention, keeping in mind the overall inventive concept of having a reduced size imaging area/laminating panel to achieve an asymmetrical wristband shape. Protective patches of face ply 134 covering the tabs 130 and wristband extender 126 may be die cut in the face ply 102 to be removed with the wristband 116 and wristband extender 126 as they are separated from the business foam 100 and peeled off to expose the underlying adhesive coating when they are applied to a patient.

The imaging area 122 is "edge justified" to the longer laminating panel 128, meaning that the imaging area 122 is proximate the left edge of the laminating panel 128 to which it is releasably adhered, with only a narrow portion of laminating panel 128 overlapping its end so that upon lamination a seal is created between the two laminating panels 127, 128 to completely encapsulate the imaging area 122. "Edge justified" is satisfied should the imaging area 122 be merely proximate the edge of the laminating panel 128. For example, the imaging area 122 could also line up with the left edge or be spaced back somewhat further away from the left edge of the laminating panel 128, it only be required that a significant gap of laminating panel 128 not be exposed at its left edge which would materially reduce the amount of imaging area available to receive printed information. For example, one could choose to place a self adhering tab adjacent the laminating panel to which the imaging area is adhered. If that were done, the imaging area would still be considered as "edge justified" as the tab would be considered a non-laminating part of the laminating panel. Similarly, one could choose to "edge justify" the imaging area to the right side of a laminating panel. This arrangement would also be considered as "edge justified" but to the right side, while the version depicted and described herein could be considered as left edge justified. It is noted that the left edge justified imaging area/laminating panel arrangement depicted and described herein is best suited for linear directional printing of information on the imaging area. Furthermore, as described in the preferred embodiment, the tab 130 adjacent the laminating panel 127 is oriented so that upon separation of the wristband 116 from the form 100, and folding panel 127 over panel 128 to laminate the imaging area 122, the glued side of tab 130 faces away from the printed surface of the imaging area 122. This orientation helps prevent inadvertent and incorrect wrapping of the strap.

The shorter laminating panel 127 provides the "real estate" in the lamination ply 102 and within the profile of the wristband 116 for die cut 125 to define the wristband extender 126 so that the full matrix 108 of labels 110 may be provided on the page size business form 100. In other words, with this inventive design, the wristband extender 126 is provided without increasing the width or height of the wristband area 114, thereby keeping it within the boundaries of a "standard" page size. This facilitates it being capable of use with existing installations with printing set up to print the earlier wristband design, but which now provides the added advantage of a wristband extender.

Figure 5:
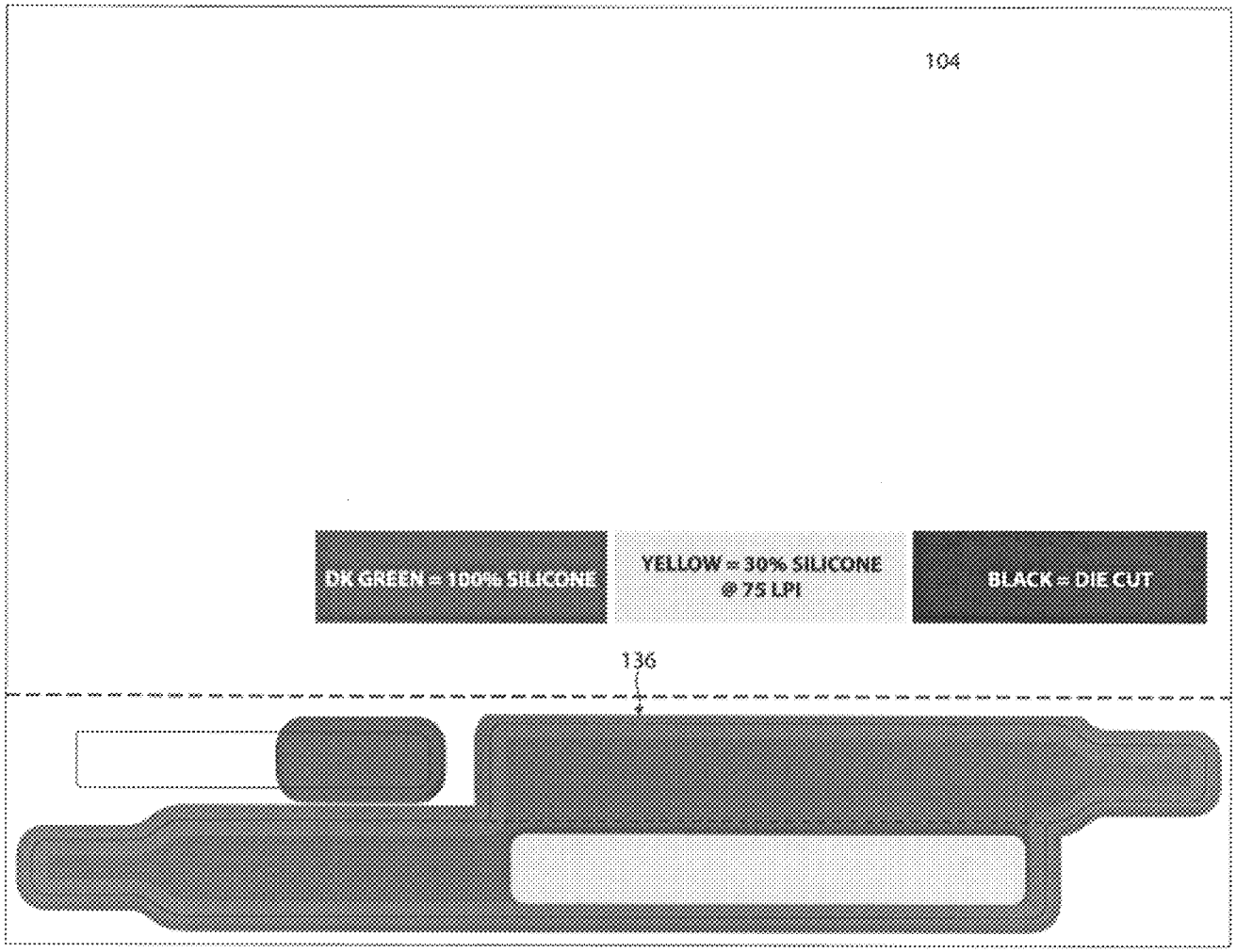
FIG. 5 is a plan view of the form detailing the silicone layer.

FIG. 5 depicts the layer of silicone 136 applied to the wristband area 114 of the business form 100, with a full layer applied to just beyond the periphery of the lamination portion 124 to facilitate its separation from the laminate ply 104, and a partial layer (approximately 30% @ 75 LPI) separating the imaging area 122 from its associated laminating panel 128 to thereby releasably adhere it. Thus, the imaging area 122 readily separates with the laminating portion 124 but may then be later peeled off to allow for substitution of another label or the like. The layer of silicone applied to the label matrix 108 is known to those of skill in the art as appropriate for self adhering labels, and is not depicted to provide clarity for the silicone layers depicted in the wristband area 114.

Figure 6:
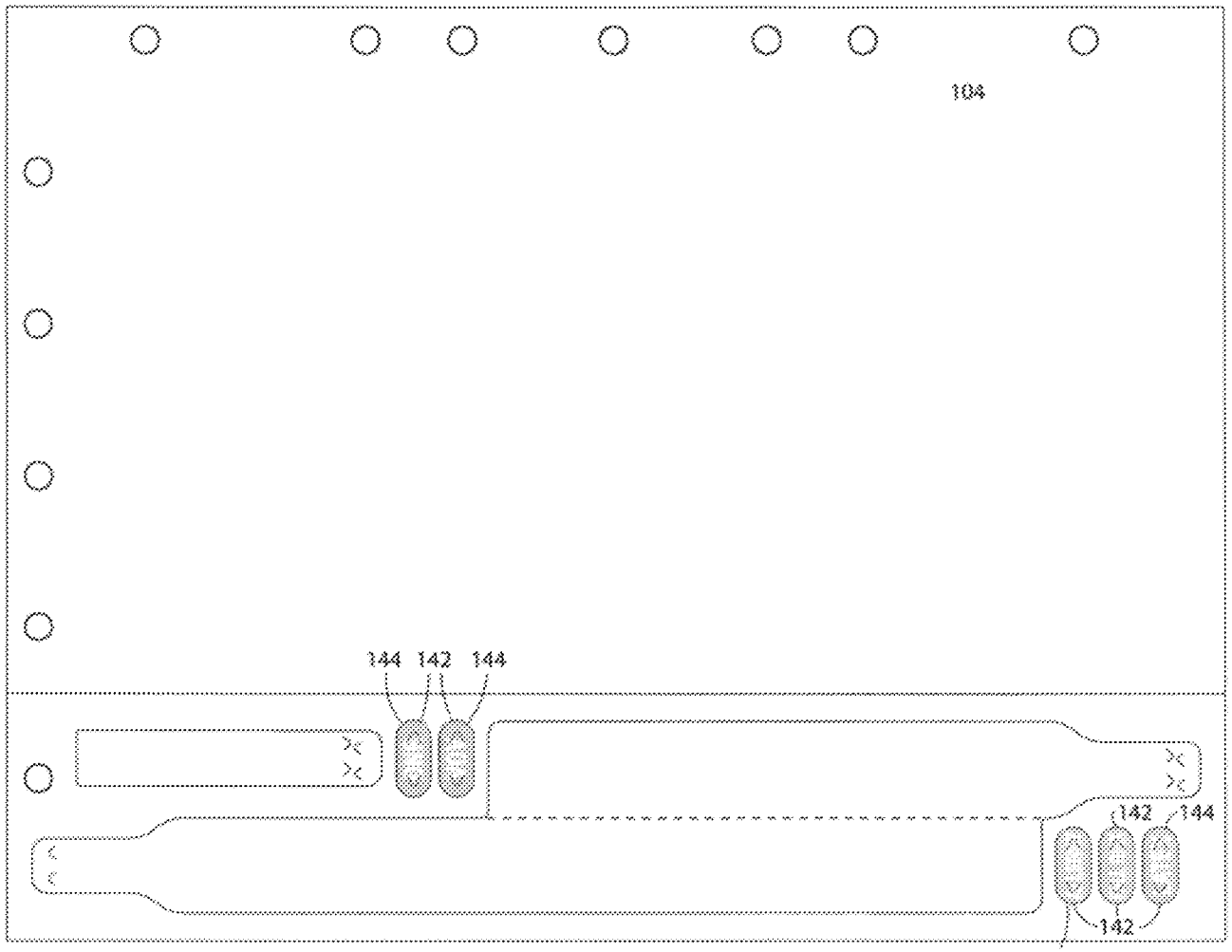
FIG. 6 is a plan view of the laminate ply with die cuts depicted for the special precautions labels.

FIGS. 2 & 6 depict a second embodiment including a pair of separated imaging areas 138, 140 with the left imaging area 138 providing space for printing the usual patient/Doctor information and the right imaging area 140 providing space for one or more special precautions labels 142 to be adhered. These special precautions labels 142 are defined by die cuts 144 in the laminate ply 104 and may be separated therefrom and applied to the imaging area 138 after separation of the wristband 116 from the business form 102 and before lamination so that they become virtually permanently affixed and resistant to tampering. These special precautions labels 140 may be color coded to help attract the attention of health care professionals as they treat the patient. Also, another set of die cuts 146 may be applied to the tabs 130 to make them tamper evident should a patient remove his/her wristband and reapply it without authority, such as when patients might seek to swap wristbands.

Various changes and modifications to the invention as illustrated by the preferred embodiments disclosed and claimed herein may be made by those of skill in the art and yet be within the teaching of the invention, which should be limited solely by the scope of the claims appended hereto and their equivalents.

What is claimed is:

1. A multi-ply business form comprising a face ply and a lamination ply underlying said face ply, said multi-ply business form including a self-laminating wristband, the wristband comprising:

a laminating portion die cut into the lamination ply, said laminating portion comprising a first laminating panel having a first laminating panel length and a second laminating panel defining a uniform width and having a second laminating panel length, said first laminating panel length being shorter than said second laminating panel length; and an imaging area die cut into said face ply, said imaging area having an imaging area length that is shorter than said first laminating panel length;

said first and second laminating panels being substantially aligned at a first end of each laminating panel, the imaging area being adhered in an edge justified orientation to one of said laminating panels at said aligned first end, wherein said first and second laminating panels are configured to fold to form a wristband defining a uniform width and a dedicated imaging area with a length less than the second laminating panel length.

2. The business form of claim 1 wherein said imaging area is left edge justified to its associated panel.

3. The business form of claim 1, wherein at least one of said laminating panels includes an integrally formed adhesive coated tab extending from said aligned first end and having a layer of adhesive oriented to adhere to an opposing lamination portion upon separation and lamination of the wristband.

4. The business form of claim 3, wherein both of said laminating panels include an integrally formed adhesive coated tab, said tabs being located at opposite ends of the laminating portion, and wherein one of said tabs is adjacent said imaging area after lamination of the wristband.

5. The business form of claim 4, wherein the imaging area is adhered to the second laminating panel, and wherein the tab for the first laminating panel extends from its aligned end and is adjacent said imaging area after lamination of the wristband, said adjacent tab having its adhesive coated surface facing away from the imaging area after lamination of the wristband.

6. The business form of claim 5 wherein said imaging area comprises a pair of separated imaging areas, each of said pair being defined by a die cut.

7. The business form of claim 6 wherein one of said pair of imaging areas is longer than the other, and further comprising a plurality of special precautions labels die cut into the lamination ply.

8. The business form of claim 5 further comprising a wristband extender die cut into the lamination ply within the profile of the laminating panels.

9. The business form of claim 5 wherein said imaging area is releasably adhered to the longer panel.

10. The business form of claim 1, further comprising a wristband extender die cut into the lamination ply within the profile of the laminating panels.

11. The business form of claim 1, wherein said imaging area is releasably adhered to the second laminating panel.

12. The business form of claim 11 wherein said business form comprises a wristband area and a label area, said wristband being positioned within said wristband area and further comprising a matrix of self adhering labels die cut into said label area.

13. The business form of claim 12 wherein a plurality of wristbands are die cut therein.

14. The business form of claim 1, wherein said business form comprises a wristband area and a label area, said wristband being positioned within said wristband area and further comprising a matrix of self adhering labels die cut into said label area.

15. The business form of claim 1, wherein a plurality of wristbands are die cut therein.

16. The business form of claim 1 wherein said business form is divided into two parts, a first part comprising a wristband area extending substantially the full width and less than the height of said business form, said wristband area containing the wristband, and a second part comprising a label area, said label area containing a matrix of a plurality of self adhering labels die cut into the face ply thereof, said wristband area including a wristband extender die cut into the lamination ply within the profile of the laminating portion, said wristband extender including a self adhering portion at least at one end thereof.

17. The business form of claim 1 wherein said imaging area is approximately 4¾ inches long and the longer of said panels is approximately 7⅞ inches long.

18. A self-laminating wristband comprising:

an imaging area; and a laminating portion, said laminating portion comprising a first laminating panel having a first laminating panel length and a second laminating panel defining a uniform width and having a second laminating panel length, said first laminating panel length being shorter than said second laminating panel length;

the imaging area having an imaging area length that is shorter than said first laminating panel length and being adhered to the second laminating panel;

said first and second laminating panels being substantially aligned at a first end of each laminating panel, the imaging area being adhered in an edge justified orientation to said second laminating panel at said aligned first end, wherein said first and second laminating panels are configured to fold to form a wristband defining a uniform width and a dedicated imaging area with a length less than the second laminating panel length.

19. The wristband of claim 18, wherein said imaging area is releasably adhered to said second laminating panel.

20. The wristband of claim 18, at least one of said laminating panels includes an integrally formed adhesive coated tab extending from said aligned first end and having a layer of adhesive oriented to adhere to an opposing lamination portion upon separation and lamination of the wristband.

21. The wristband of claim 20, wherein said integrally formed tab extending from said second laminating panel includes an adhesively coated portion and extends from a second end of said second laminating panel and being opposite said aligned first end.

22. The wristband of claim 18 wherein said imaging area is approximately 4¾ inches long and its associated lamination panel is approximately 7⅞ inches long.

23. A sheetlet comprising a face ply and a lamination ply underlying said face ply, and a separable self-laminating wristband die cut therein, the wristband comprising:

(1) an imaging area die cut into said face ply; and a laminating portion die cut into the lamination ply, said laminating portion comprising a first laminating panel having a first laminating panel length and a second laminating panel defining a uniform width and having a second laminating panel length, said first laminating panel length being shorter than said second laminating panel length;

having an imaging area length that is shorter than said first laminating panel length and being adhered to said second laminating panel, said first and second laminating panels being substantially aligned at a first end of each laminating panel, the imaging area being adhered in an edge justified orientation to said second laminating panel at said aligned first end, wherein said first and second laminating panels are configured to fold to form a wristband defining a uniform width and a dedicated imaging area with a length less than the second laminating panel length.

24. The sheetlet of claim 23, further comprising a wristband extender die cut into the lamination ply, said wristband extender including a self adhering portion at least at one end thereof and positioned adjacent the first lamination panel so as to minimize the height of said sheetlet.

25. The sheetlet of claim 23 wherein said imaging area is approximately 4¾ inches long and its associated lamination panel is approximately 7⅞ inches long.

26. The sheetlet of claim 23 wherein said imaging area is releasably adhered to the said second laminating panel.

27. The sheetlet of claim 23, wherein each of said laminating panels includes an integrally formed tab extending from an end thereof for securing the wristband upon separation of the wristband from the business form.

28. A multi-ply business form comprising a self-laminating wristband, the wristband having an imaging area die cut into a face ply and a laminating portion die cut into a lamination ply, said laminating portion comprising a first full length laminating portion defining a uniform width and a second laminating portion having a length less than the first full length laminating portion and merely sufficient to laminate the imaging area;

and an integrally formed self-adhering fastening tab at opposite ends of each of said first and second laminating portions for securing the wristband after its separation from the business form, wherein said first and second laminating portions are configured to fold to form a wristband defining a uniform width and the imaging area having a length less than the first laminating portion length.

29. A multi-ply business form comprising a self-laminating wristband, the wristband comprising an imaging area die cut into a face ply and a laminating portion die cut into an underlying lamination ply, said laminating portion having a first part defining a uniform width extending the full length of the wristband and having the imaging area adhered thereto near an end thereof and a second part sized and positioned to be folded over and laminate the imaging area upon separation of the wristband from the form, both of the imaging area and the second part extending for a length insufficient to encircle an adult patient's wrist so as to form a dedicated imaging area with a length less than the first laminating portion length, and a pair of tabs integrally formed at opposing ends of the laminating portion.

30. A multi-ply business form comprising a self-laminating wristband, the wristband comprising an imaging area die cut into a face ply and a laminating portion die cut into an underlying lamination ply, said laminating portion having a first full length part defining a uniform width and a second shorter length part, said second part being sized to just laminate the imaging area and the imaging area being sized to be smaller than an adult patient's wrist so as to form a dedicated imaging area with a length less than the first laminating portion length, each of said parts having a tab at an end thereof for securing the wristband to a patient's wrist, the imaging area being adhered at an end opposite the tab end of said first full length part and oriented to be laminated after separation of the wristband from the business form by folding the second part over the first part.

* * * * *